US009681239B2

(12) United States Patent
Lee et al.

(10) Patent No.: US 9,681,239 B2
(45) Date of Patent: Jun. 13, 2017

(54) AUDIO OUTPUT APPARATUS AND METHOD FOR AUDIO CORRECTION

(71) Applicant: SAMSUNG ELECTRONICS CO., LTD., Suwon-si (KR)

(72) Inventors: Jae-cheol Lee, Yongin-si (KR); Kee-yeong Cho, Seongnam-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 255 days.

(21) Appl. No.: 14/266,111

(22) Filed: Apr. 30, 2014

(65) Prior Publication Data

US 2015/0117651 A1 Apr. 30, 2015

(30) Foreign Application Priority Data

Oct. 31, 2013 (KR) ..... 10-2013-0131207

(51) Int. Cl.
*H04R 29/00* (2006.01)
*H04R 3/04* (2006.01)

(52) U.S. Cl.
CPC ..... *H04R 29/00* (2013.01); *H04R 3/04* (2013.01); *H04R 2499/11* (2013.01)

(58) Field of Classification Search
None
See application file for complete search history.

(56) References Cited

U.S. PATENT DOCUMENTS 5,727,074 A * 3/1998 Hildebrand ..... H03G 5/005 333/28 T
6,674,864 B1 * 1/2004 Kitamura ..... H03G 5/005 381/103
2006/0016324 A1 * 1/2006 Hsieh ..... H04R 3/04 84/622
2009/0225996 A1 * 9/2009 Brooking ..... H04R 3/04 381/59
2009/0249420 A1 * 10/2009 Kim ..... H04L 12/2807 725/115
2011/0222696 A1 * 9/2011 Balachandran ..... H04R 29/001 381/58
2011/0235808 A1 * 9/2011 Kon ..... H04R 3/12 381/17
2013/0163780 A1 * 6/2013 Blair ..... H04R 3/12 381/77
2014/0112484 A1 * 4/2014 Britt, Jr. ..... H04R 29/001 381/59

FOREIGN PATENT DOCUMENTS

EP 1966938 B1 8/2012

* cited by examiner

*Primary Examiner* — Joseph Saunders, Jr.
*Assistant Examiner* — James Mooney
(74) *Attorney, Agent, or Firm* — Sughrue Mion, PLLC

(57) ABSTRACT

An audio output apparatus and a method for audio correction is provided. An audio correction method of an audio output apparatus may include receiving a test signal from a terminal device, generating correction filter information of the terminal device based on the received test signal and a standard signal of the terminal device, and in response to an audio signal being received from the terminal device, correcting the received audio signal based on the correction filter information.

18 Claims, 8 Drawing Sheets

AUDIO OUTPUT APPARATUS AND METHOD FOR AUDIO CORRECTION

CROSS-REFERENCE TO RELATED APPLICATION

This application claims priority from Korean Patent Application No. 10-2013-0131207, filed on Oct. 31, 2013 in the Korean Intellectual Property Office, the disclosure of which is incorporated herein by reference in its entirety.

BACKGROUND

Field

Apparatuses and methods consistent with the exemplary embodiments relate to an audio output apparatus and method. In particular, exemplary embodiments relate to an audio output apparatus and method for audio correction.

Description of the Related Art

A related art audio output apparatus corrects an audio signal of a predetermined device, or corrects an output audio signal in consideration of characteristics of a speaker.

The related art audio output apparatus is physically connected to or performs wireless communication with a plurality of terminal devices capable of an audio output, receives an audio signal from a terminal device, and outputs the audio signal through a speaker.

However, the related art audio output apparatus only corrects an audio signal received from a predetermined device. Accordingly, when the related art audio output apparatus is physically connected to or performs wireless communication with other terminal devices except for the predetermined device and receives an audio signal, the audio output apparatus does not correct an error which may be generated while receiving the audio signal and outputting the audio signal through the speaker. Instead, the related art audio output apparatus outputs the distorted audio signal through the speaker.

SUMMARY

Exemplary embodiments may overcome the above disadvantages and other disadvantages not described above. Also, the exemplary embodiments are not required to overcome the disadvantages described above, and an exemplary embodiment may not overcome any of the problems described above.

The exemplary embodiments may provide an audio output apparatus capable of correcting audio signals of diverse terminal devices.

According to an aspect of an exemplary embodiment, there is provided an audio correction method of an audio output apparatus, the audio correction method including receiving a test signal from a terminal device, generating correction filter information of the a terminal device based on the received test signal and a standard signal of the terminal device, and in response to an audio signal being received from the terminal device, correcting the received audio signal based on the correction filter information.

The method may further include receiving device information of the terminal device from the terminal device, acquiring the standard signal of the terminal device among a plurality of pre-stored standard signals based on the received device information, and in response to the test signal being received from the terminal device, converting the received test signal into a digital signal.

The acquiring the standard signal further includes in response to receiving a selection command to select at least one device information among the received device information, the standard signal of the terminal device, which is related to the device information corresponding to the selection command, may be acquired among the plurality of pre-stored standard signals.

The method may further include generating an audio test signal for the converted digital signal, converting the audio test signal into another digital signal, and wherein the generating includes generating the correction filter information of the terminal device based on the other digital signal and the acquired standard signal.

The generating includes generating the correction filter information of the terminal device based on the other digital signal, the acquired standard signal, and a supply voltage of an outputter which is configured to output the audio test signal to a speaker.

The generating includes generating the correction filter information of the terminal device based on the other digital signal, the acquired standard signal, and an output voltage of an outputter which is configured to output the audio test signal to a speaker.

The method may further include generating an audio test signal for the converted digital signal, and outputting the audio test signal through a speaker, receiving the output audio test signal from the speaker through a microphone, converting the audio test signal into another digital signal, and wherein the generating includes generating the correction filter information of the terminal device based on the other digital signal and the acquired standard signal.

The generating includes generating the correction filter information of the terminal device based on the other digital signal, the acquired standard signal, and a supply voltage of an outputter which is configured to output the audio test signal to a speaker.

The generating the correction filter information further includes generating the correction filter information of the terminal device which is configured to transmit the test signal based on the another digital signal, the acquired standard signal, and an output voltage of an outputter which is configured to output the audio test signal to a speaker.

According to an aspect of another exemplary embodiment, there is provided an audio output apparatus including a communicator configured to receive a test signal from a terminal device, an outputter configured to output an audio signal received from the terminal device through a speaker, and a controller configured to, in response to the communicator receiving the test signal, generate correction filter information of the terminal device based on the received test signal and a standard signal of the terminal device, and in response to the audio signal being received from the terminal device, correct the received audio signal based on the correction filter information.

The audio output apparatus may further include a storage configured to store the standard signal of the terminal device and the correction filter information to correct the received audio signal, and a signal processor configured to convert the received test signal into a digital signal, wherein the controller is configured to, in response to device information being received from the terminal device, acquire the standard signal of the terminal device from the storage based on the received device information, and control the signal processor to process the test signal.

The audio output apparatus may further include an inputter configured to receive a user command, wherein in response to a selected user command being input through the inputter to select the device information, the controller may be further configured to acquire the standard signal of the terminal device related to the device information from the storage.

The outputter may be further configured to output an audio test signal to the speaker for the converted digital signal, and the controller may be further configured to control the signal processor to process the audio test signal which is output to the speaker, and generate the correction filter information of the terminal device based on the processed audio test signal and the acquired standard signal.

The audio output apparatus may further include a power supplier configured to supply power, wherein the controller may be further configured to generate the correction filter information of the terminal device based on the processed audio test signal, the acquired standard signal, and a supply voltage of the power which is supplied from the power supplier to the outputter.

The audio output apparatus may further include a power supplier configured to supply power, wherein the controller may be further configured to generate the correction filter information of the terminal device based on the audio test signal converted into the digital signal, the acquired standard signal, and an output voltage of the power which is supplied from the power supplier to the outputter.

The audio output apparatus may further include a microphone, wherein the outputter may be configured to output an audio test signal through the speaker for the converted digital signal, and wherein the controller is configured to, in response to the audio test signal output through the speaker being input through the microphone, control the signal processor to process the audio test signal, and generate the correction filter information of the terminal device based on the processed audio test signal and the acquired standard signal.

The audio output apparatus may further include a power supplier configured to supply power, wherein the controller may be configured to generate the correction filter information of the terminal device based on the processed audio test signal, the acquired standard signal, and a supply voltage of the power which is supplied from the power supplier to the outputter.

The audio output apparatus may further include a power supplier configured to supply power, wherein the controller may be configured to generate the correction filter information of the terminal device based on the processed audio test signal, the acquired standard signal, and an output voltage of the power which is supplied from the power supplier to the outputter.

According to another aspect of an exemplary embodiment, an audio correction method of an audio output apparatus may include receiving a test signal and device information from at least one terminal device, displaying a notification message for selecting a terminal device of the at least one terminal device based on the received device information, acquiring a standard signal corresponding to the selected terminal device, receiving an audio signal from the selected terminal device, correcting the received audio signal based on the standard signal.

The audio output apparatus according to the diverse exemplary embodiments of the present invention may correct audio signals of diverse terminal devices.

BRIEF DESCRIPTION OF THE DRAWINGS

The above and/or other aspects will be more apparent by describing certain exemplary embodiments with reference to the accompanying drawings, in which.

DETAILED DESCRIPTION OF EXEMPLARY EMBODIMENTS

Figure 1:
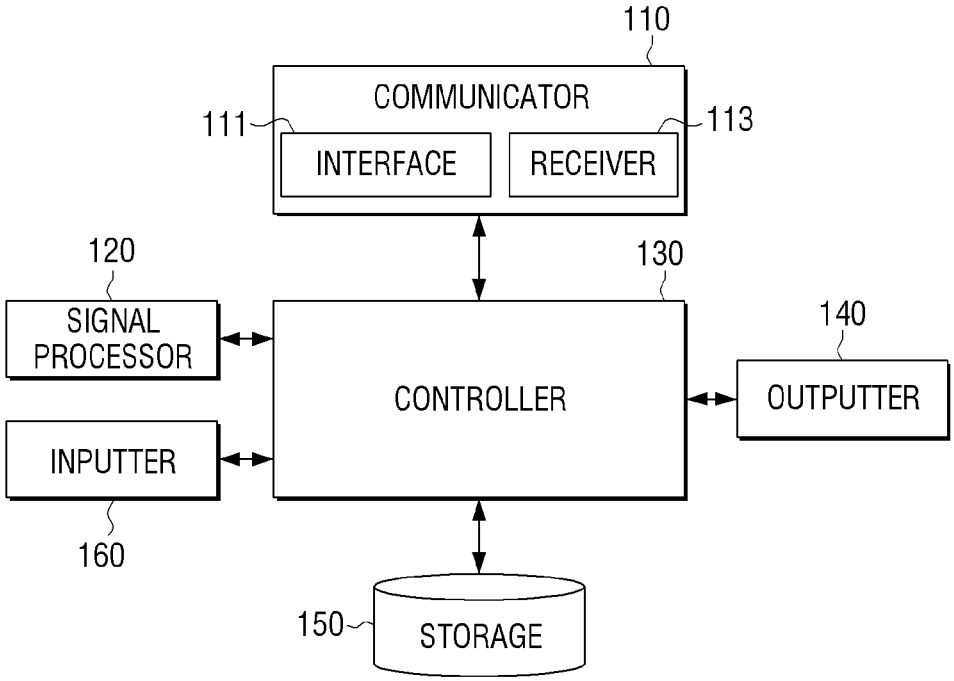
FIG. 1 is a block diagram of an audio output apparatus consistent with an exemplary embodiment.

Certain exemplary embodiments will now be described in greater detail with reference to the accompanying drawings.

In the following description, same drawing reference numerals are used for the same elements even in different drawings. The matters defined in the description, such as detailed construction and elements, are provided to assist in a comprehensive understanding of the exemplary embodiments. Thus, it is apparent that the exemplary embodiments can be carried out without those specifically defined matters. Also, well-known functions or constructions are not described in detail since they would obscure the exemplary embodiments with unnecessary detail.

FIG. 1 is a block diagram of an audio output apparatus consistent with an exemplary embodiment.

With reference to FIG. 1, the audio output apparatus may include a communicator 110, a signal processor 120, a controller 130, an outputter 140, a storage 150, and an inputter 160.

The communicator 110 communicates with at least one of a plurality of terminal devices by a cable or wireless communication, and receives a test signal. The terminal device may be a device which is capable of cable or wireless communication, for example a smart phone, a tablet personal computer (PC), a smart television (TV). The terminal device also may output an audio signal related to contents.

Accordingly, the communicator 110 may receive an audio signal output from at least one of the plurality of terminal devices through the cable or wireless communication. Before receiving such an audio signal, when the communicator 110 starts communication with at least one of the plurality of terminal devices by the cable or wireless communication, the communicator 110 receives a test signal from the terminal device. The test signal is a signal to test whether noise is generated in the process of outputting an audio signal received from the terminal device using the audio output apparatus.

The communicator 110 may include an interface 111 and a receiver 113, and receive a test signal from at least one of the plurality of terminal devices through at least one of the interface 111 and the receiver 113. In particular, the interface 111 is physically connected to at least one of the plurality of terminal devices, and receives a test signal from the terminal device. The interface 111 may receive a digital test signal through a communication cable such as Sony Philips digital interface (SPDIF) and high definition multimedia interface (HDMI), or receive an analog test signal through a communication cable.

The receiver 113 wirelessly receives a test signal from a terminal device capable of wireless communication, among the plurality of terminal devices. The receiver 113 may communicate with a terminal device capable of wireless communication using diverse wireless communication standards such as wireless fidelity (WiFi), $3^{rd}$ generation (3G), $3^{rd}$ generation partnership project (3GPP), long term evolution (LTE), etc., and receive a test signal.

The signal processor 120 converts a test signal received through the interface 111 or the receiver 113 into a digital signal. The controller 130 controls overall operation of the components of the audio output apparatus. In particular, when a test signal is received from at least one terminal device through the communicator 110 including the interface 111 and the receiver 113, the controller 130 generates correction filter information of the terminal device based on the received test signal and a standard signal of the terminal device. Subsequently, when an audio signal is received from the terminal device, the controller 130 corrects the received audio signal based on the correction filter information of the terminal device, and controls the outputter 140 to output the corrected audio signal.

In particular, when a test signal is received from at least one terminal device through the interface 111 or the receiver 113, the controller 130 determines whether the received test signal is an analog signal or a digital signal. When the received test signal is an analog signal, the signal processor 120 converts the analog test signal into a digital signal in accordance with a control command of the controller 130.

In one exemplary embodiment, the audio output apparatus may be physically connected to a first terminal device through the interface 111, and the first terminal device may transmit an analog test signal to the audio output apparatus. The test signal may be received through the interface 111, and the signal processor 120 may convert the analog test signal into a digital signal.

In another exemplary embodiment, a second terminal device may transmit a digital test signal to the audio output apparatus in a wireless communication method such as Bluetooth, and the receiver 113 may receive the digital test signal from the second terminal device using the wireless communication method.

When a received test signal is converted into a digital signal or when a digital test signal is received, the controller 130 generates correction filter information of a terminal device which transmits the test signal based on the digital test signal and a standard signal of the terminal device.

In particular, the storage 150 may store predetermined standard signals of the plurality of terminal devices. The storage 150 is a storage medium which stores diverse programs to operate the audio output apparatus. The storage 150 may be implemented with a memory, a hard disk drive (HDD), etc. For example, the storage 150 may include a read-only memory (ROM) which stores programs to operate the controller 130, and a random access memory (RAM) which temporarily stores data to operate the controller 130. In addition, the storage 150 may further include an electrically erasable and programmable ROM (EEROM) which stores diverse reference data.

The terminal device which transmits the test signal may transmit device information of the terminal device together with the test signal. Accordingly, the controller 130 may acquire a standard signal of the terminal device from the standard signals pre-stored in the storage 150 based on the device information of the terminal device. In other words, the controller 130 may select and acquire the standard signal, from the standard signals pre-stored in the storage 150, which corresponds with the device information transmitted from the terminal device.

According to an additional aspect of the exemplary embodiments, when the audio output apparatus is physically connected to at least one terminal device through the interface 111 or starts communication with at least one terminal device through the receiver 113 and receives device information, the controller 130 generates a notification message based on the received device information, and controls the outputter 140 to display the notification message on screen. Subsequently, when a command to select the terminal device corresponding to the notification message displayed on screen is input through the inputter 160 to receive a user command, the controller 130 may acquire the standard signal of the terminal device which corresponds to the input selection command from among a plurality of standard signals stored in the storage 150.

When the standard signal is acquired, the controller 130 determines whether noise is generated in the test signal of the terminal device based on the acquired standard signal. When it is determined that noise is generated in the test signal, the controller 130 generates correction filter information to correct the test signal based on the acquired standard signal, and stores the generated correction filter information in the storage 150.

Subsequently, when the audio output apparatus receives an audio signal from the terminal device, the controller 130 corrects the audio signal based on the correction filter information stored in the storage 150. Accordingly, the outputter 140 may output the corrected audio signal through the speaker 170.

Generating correction filter information to correct an audio signal of a terminal device which transmits a test signal at the audio output apparatus is described below in greater detail with reference to FIGS. 2 to 5.

Figure 2:
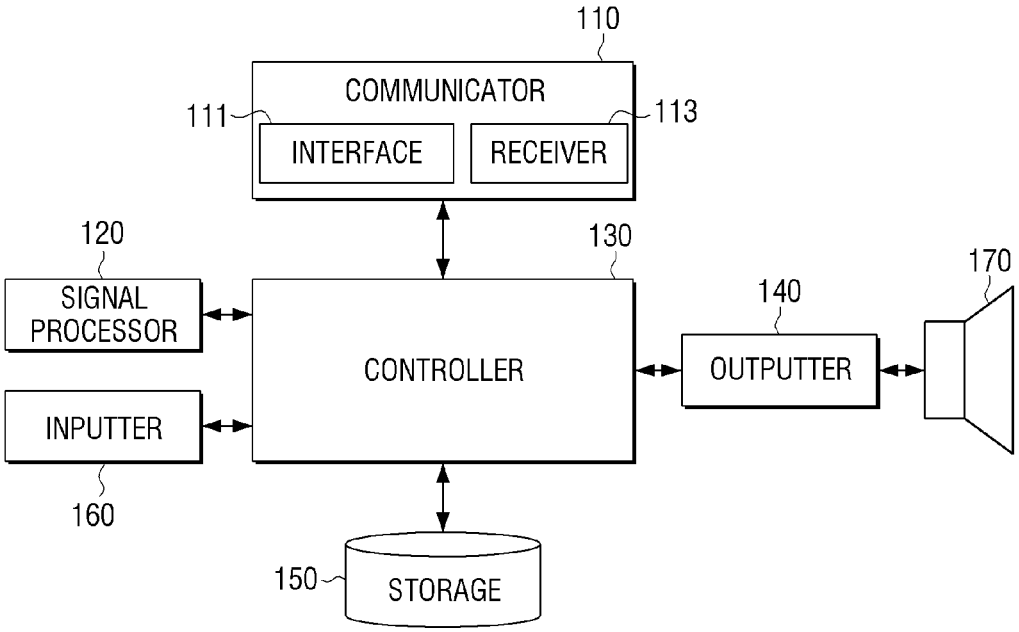
FIG. 2 illustrates a first example to correct an audio signal of a terminal device using an audio output apparatus consistent with an exemplary embodiment.

FIG. 2 illustrates a first example to correct an audio signal of a terminal device using an audio output apparatus consistent with an exemplary embodiment.

With reference to FIG. 2, the audio output apparatus may include a communicator 110 including an interface 111 and a receiver 113, a signal processor 120, a controller 130, an outputter 140, a storage 150, an inputter 160, and a speaker 170. Since these components have been described in detail with reference to FIG. 1, description is not repeated.

The controller 130 may generate correction filter information based on a test signal output to the speaker 170 through the outputter 140. In particular, in order to output a test signal which is converted into a digital signal or is received in a digital signal format through the speaker 170, the outputter 140 converts the test signal into an audio test signal in accordance with a control command of the controller 130. When the audio test signal is generated to output through the speaker 170, the controller 130 controls the signal processor 120 to process the audio test signal to output through the speaker 170. Accordingly, the signal processor 120 processes the audio test signal to output through the speaker 170. When the audio test signal is processed into a digital signal, the controller 130 generates correction filter information of a terminal device which transmits the test signal based on the processed audio test signal and an acquired standard signal, and stores the correction filter information in the storage 150.

Subsequently, when an audio signal is received from the terminal device, the controller 130 corrects the audio signal based on the stored correction filter information. Accordingly, the outputter 140 may output the corrected audio signal through the speaker 170.

As described above, the audio output apparatus consistent with the exemplary embodiment may not only correct an audio signal having an error generated at a terminal device and an error generated in the process of transmitting an audio signal from the terminal device to the audio output apparatus, but may also correct an audio signal having an error generated in the process of outputting an audio signal through the speaker 170.

Figure 3:
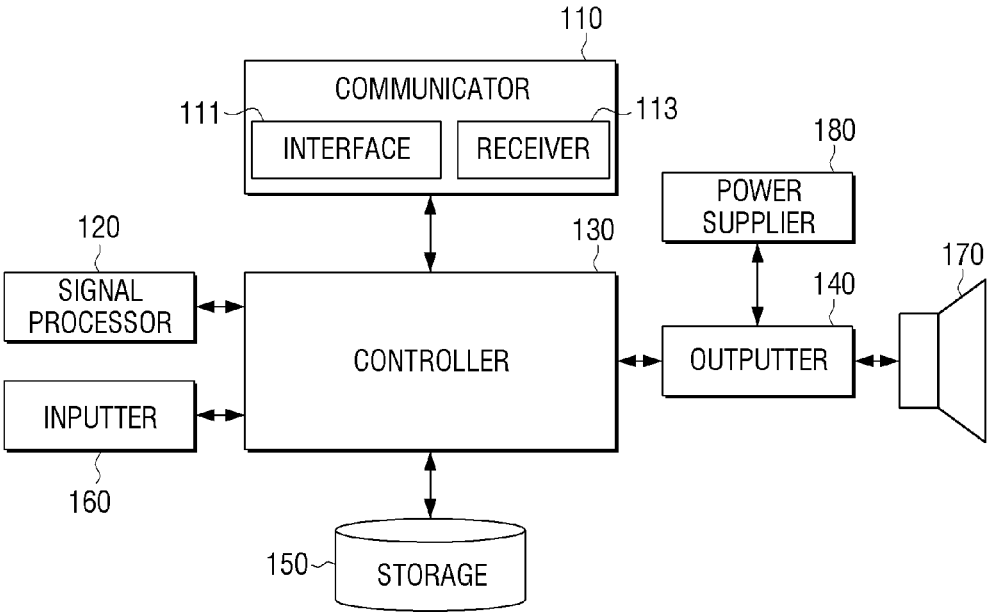
FIG. 3 illustrates a second example to correct an audio signal of a terminal device using an audio output apparatus consistent with another exemplary embodiment.

FIG. 3 illustrates a second example to correct an audio signal of a terminal device using an audio output apparatus consistent with another exemplary embodiment.

As described with reference to FIG. 1, the audio output apparatus may include a communicator 110 including an interface 111 and a receiver 113, a signal processor 120, a controller 130, an outputter 140, a storage 150, an inputter 160, and a speaker 170. Since these components have been described in detail with reference to FIG. 1, description is not repeated. The audio output apparatus may further include a power supplier 180 as shown in FIG. 3. The power supplier 180 supplies power to the components of the audio output apparatus. Accordingly, the components of the audio output apparatus are operated by power supplied from the power supplier 180.

The controller 130 may generate correction filter information based on a test signal output to the speaker 170 through the outputter 140 and power supplied from the power supplier 180 to the outputter 140.

In particular, in order to output a test signal which is converted into a digital signal or is received in a digital signal format through the speaker 170, the outputter 140 converts the test signal into an audio test signal in accordance with a control command of the controller 130. When the audio test signal is generated to output through the speaker 170, the controller 130 controls the signal processor 120 to process the audio test signal to output through the speaker 170. Accordingly, the signal processor 120 processes the audio test signal to output through the speaker 170. When the audio test signal is processed into a digital signal, the controller 130 generates correction filter information of a terminal device which transmits the test signal based on the processed audio test signal and an acquired standard signal, and stores the correction filter information in the storage 150.

At this time, the controller 130 may match a reference voltage of power supplied to the outputter 140 with the generated correction filter information, and store the matched information in the storage 150. In one exemplary embodiment, the controller 130 may match a supply voltage (hereinafter, "a reference supply voltage") of power supplied to the outputter 140 with the generated correction filter information, and store the matched information in the storage 150. In another exemplary embodiment, the controller 130 may match an output voltage (hereinafter, "a reference output voltage") of power supplied to the outputter 140 with the generated correction filter information, and store the matched information in the storage 150.

Subsequently, when an audio signal is received from the terminal device, the controller 130 corrects the audio signal based on the stored correction filter information. At this time, the controller 130 compares the reference voltage, which is matched with the correction filter information of the terminal device and is stored in the storage 150, with a supply voltage of the outputter 140 to output the corrected audio signal. The reference voltage may include the reference supply voltage and the reference output voltage. In particular, the controller 130 determines whether the supply voltage of the outputter 140 to output the corrected audio signal is within a predetermined critical range of the reference supply voltage or the reference output voltage. When it is determined that the supply voltage of the outputter 140 is not within the predetermined critical range, the controller 130 controls the power supplier 180 to adjust the supply voltage of the outputter 140 to the reference supply voltage or the reference output voltage. Accordingly, the power supplier 180 may adjust power supplied to the outputter 140 based on the reference supply voltage when it is determined that the supply voltage of the outputter is not within the predetermined critical range. When the supply voltage of the outputter 140 is adjusted to the reference supply voltage or the reference output voltage by this power supply adjusting process, the controller 130 corrects the received audio signal based on the acquired correction filter information, and transmits the corrected audio signal to the outputter 140. Accordingly, the outputter 140 may output the corrected audio signal through the speaker 170.

As described above, the audio output apparatus, consistent with the exemplary embodiment, may not only correct an audio signal having an error generated at a terminal device and an error generated in the process of transmitting an audio signal from the terminal device to the audio output apparatus, but may also correct an audio signal having an error generated in the process of outputting an audio signal through the speaker 170 and an error generated in the process of supplying power.

Figure 4:
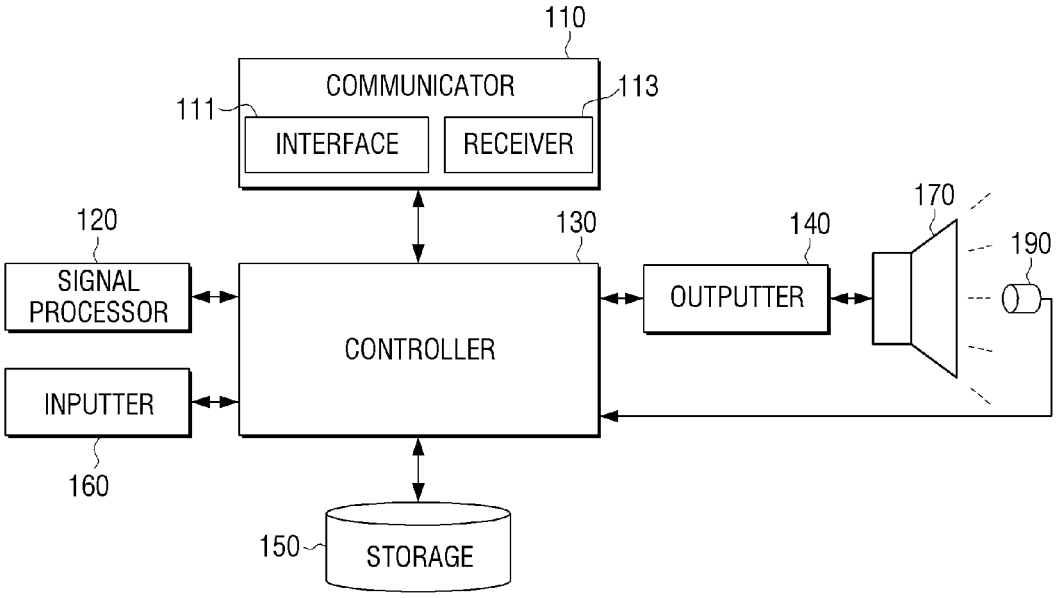
FIG. 4 illustrates a third example to correct an audio signal of a terminal device using an audio output apparatus consistent with yet another exemplary embodiment.

FIG. 4 illustrates a third example to correct an audio signal of a terminal device using an audio output apparatus consistent with yet another exemplary embodiment.

As described with reference to FIG. 1, the audio output apparatus may include a communicator 110 including an interface 111 and a receiver 113, a signal processor 120, a controller 130, an outputter 140, a storage 150, an inputter 160, and a speaker 170. Since these components have been described in detail with reference to FIG. 1, description is not repeated. The audio output apparatus may further include a microphone 190 as shown in FIG. 4. According to an exemplary embodiment, the microphone 190 may receive an audio test signal output through the speaker 170.

Accordingly, the controller 130 may generate correction filter information based on the audio test signal input through the microphone 190. In particular, in order to output a test signal which is converted into a digital signal or is received in a digital signal format through the speaker 170, the outputter 140 converts the test signal into an audio test signal in accordance with a control command of the controller 130. The audio test signal is output through the speaker 170, and the microphone 190 may receive the output audio test signal.

When the audio test signal is input through the microphone 190, the controller 130 controls the signal processor 120 to process the input audio test signal. Accordingly, the signal processor 120 processes the input audio test signal. When the input audio test signal is converted into a digital signal, the controller 130 may generate correction filter information of a terminal device which transmits the test signal based on the digital audio test signal and an acquired standard signal, and store the correction filter information in the storage 150.

Subsequently, when an audio signal is received from the terminal device, the controller 130 corrects the audio signal based on the stored correction filter information and transmits the corrected audio signal to the outputter 140. Accordingly, the outputter 140 may output the corrected audio signal through the speaker 170.

As described above, the audio output apparatus, consistent with the exemplary embodiment, may not only correct an audio signal having an error generated at a terminal device and an error generated in the process of transmitting an audio signal from the terminal device to the audio output apparatus, but may also correct an audio signal having an error generated in the process of outputting an audio signal through the speaker 170.

Figure 5:
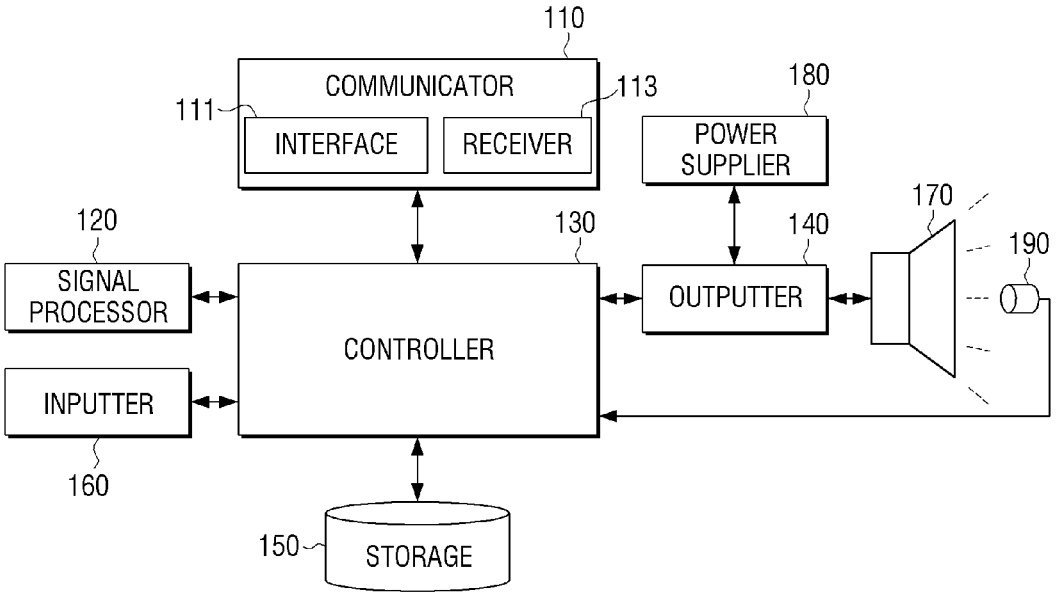
FIG. 5 illustrates a fourth example to correct an audio signal of a terminal device using an audio output apparatus consistent with yet another exemplary embodiment.

FIG. 5 illustrates a fourth example to correct an audio signal of a terminal device using an audio output apparatus consistent with yet another exemplary embodiment.

As described with reference to FIGS. 1 to 4, the audio output apparatus may include a communicator 110 including an interface 111 and a receiver 113, a signal processor 120, a controller 130, an outputter 140, a storage 150, an inputter 160, and a speaker 170, a power supplier 180, and a microphone 190. Since these components have been described in detail with reference to FIGS. 1 to 4, description is not repeated.

The controller 130 may generate correction filter information based on an audio test signal input through the microphone 190 and power supplied from the power supplier 180 to the outputter 140. In particular, in order to output a test signal which is converted into a digital signal or is received in a digital signal format through the speaker 170, the outputter 140 converts the test signal into an audio test signal in accordance with a control command of the controller 130. The audio test signal is output through the speaker 170, and the microphone 190 may receive the output audio test signal.

When the audio test signal is input through the microphone 190, the controller 130 controls the signal processor 120 to process the input audio test signal. Accordingly, the signal processor 120 processes the input audio test signal. When the input audio test signal is converted into a digital signal, the controller 130 may generate correction filter information of a terminal device which transmits the test signal based on the digital audio test signal and an acquired standard signal, and store the correction filter information in the storage 150.

The controller 130 may match a reference voltage of the outputter 140, which outputs the audio test signal to the speaker 170, with the generated correction filter information, and store the matched information in the storage 150. In one exemplary embodiment, the controller 130 may match a supply voltage (hereinafter, "a reference supply voltage") of power supplied to the outputter 140 with the generated correction filter information, and store the matched information in the storage 150. In another exemplary embodiment, the controller 130 may match an output voltage (hereinafter, "a reference output voltage") of power supplied to the outputter 140 with the generated correction filter information, and store the matched information in the storage 150.

Subsequently, when an audio signal is received from the terminal device, the controller 130 corrects the audio signal based on the stored correction filter information. At this time, the controller 130 compares the reference voltage, which is matched with the correction filter information of the terminal device and is stored in the storage 150, with a supply voltage of the outputter 140 to output the corrected audio signal. The reference voltage may include the reference supply voltage and the reference output voltage. In particular, the controller 130 determines whether the supply voltage of the outputter 140 to output the corrected audio signal is within a predetermined critical range of the reference supply voltage or the reference output voltage. When it is determined that the supply voltage of the outputter 140 is not within the predetermined critical range, the controller 130 controls the power supplier 180 to adjust the supply voltage of the outputter 140 to the reference supply voltage or the reference output voltage. Accordingly, the power supplier 180 may adjust power supplied to the outputter 140 based on the reference supply voltage when the supply voltage of the outputter 140 is not within the predetermined critical range. When the supply voltage of the outputter 140 is adjusted to the reference supply voltage or the reference output voltage by this power supply adjusting process, the controller 130 corrects the received audio signal based on the acquired correction filter information, and transmits the corrected audio signal to the outputter 140. Accordingly, the outputter 140 may output the corrected audio signal through the speaker 170.

As described above, the audio output apparatus, consistent with the exemplary embodiment, may not only correct an audio signal having an error generated at a terminal device and an error generated in the process of transmitting an audio signal from the terminal device to the audio output apparatus, but may also correct an audio signal having an error generated in the process of outputting an audio signal through the speaker 170 and an error generated in the process of supplying power.

Correcting and outputting an audio signal of at least one of a plurality of terminal devices at the audio output apparatus, consistent with diverse exemplary embodiments, have not yet been described in detail.

A method for correcting an audio signal received from at least one of a plurality of terminal devices at the audio output apparatus according to an exemplary embodiment is described below in greater detail.

Figure 6:
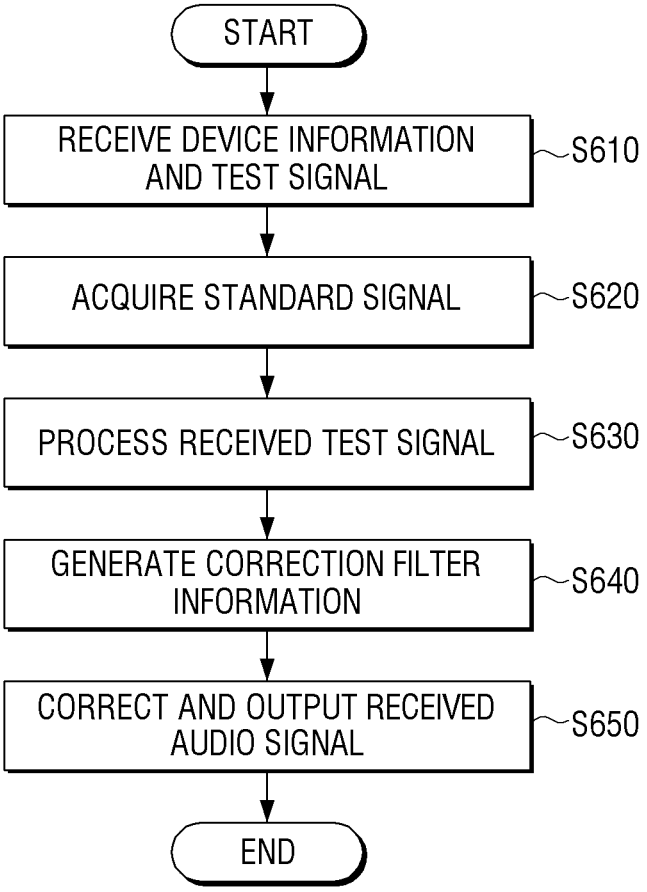
FIG. 6 is a flowchart of an audio correction method of an audio output apparatus according to an exemplary embodiment.

FIG. 6 is a flowchart of an audio correction method of an audio output apparatus according to an exemplary embodiment.

With reference to FIG. 6, the audio output apparatus receives a test signal and device information from at least one terminal device which is physically connected or starts wireless communication among a plurality of terminal devices (S610). Subsequently, based on the received device information, the audio output apparatus acquires a standard signal of the terminal device which transmits the test signal from among a plurality of pre-stored standard signals (S620). The acquired standard signal of the terminal device corresponds with the received device information. However, the exemplary embodiments are not limited thereto. The audio output apparatus may generate a notification message based on the received device information and display the notification message on screen. Subsequently, when a command to select a terminal device corresponding to the notification message displayed on screen is input, the audio output apparatus may acquire a standard signal of the terminal device corresponding to the input selection command.

When the standard signal is acquired, the audio output apparatus converts the received test signal into a digital signal (S630). In one exemplary embodiment, at least one of a plurality of terminal devices may be physically connected to the audio output apparatus through the interface 111 of the audio output apparatus, and may transmit an analog test signal to the audio output apparatus. In another exemplary embodiment, another one of a plurality of terminal devices may transmit a digital test signal to the audio output apparatus in a wireless communication method. Accordingly, the audio output apparatus receives a test signal from at least one of the plurality of terminal devices, and determines whether or not the received test signal is a digital signal. When the received test signal is an analog signal, the audio output apparatus may convert the analog test signal into a digital signal.

When an analog test signal is converted into a digital signal or a digital test signal is received, the audio output apparatus generates correction filter information of the terminal device which transmits the test signal based on the digital test signal and the acquired standard signal, and stores the correction filter information (S640). Subsequently, when an audio signal is received from the terminal device, the audio output apparatus corrects the audio signal based on the generated correction filter information of the terminal device, and outputs the corrected audio signal through the speaker (S650).

The audio output apparatus according to the exemplary embodiments may correct an audio signal of all the terminal devices capable of outputting the audio signal through the audio output apparatus as well as a predetermined terminal device, and output audio.

A method for generating correction filter information to correct an audio signal of a terminal device at the audio output apparatus according to an exemplary embodiment is described below.

Figure 7:
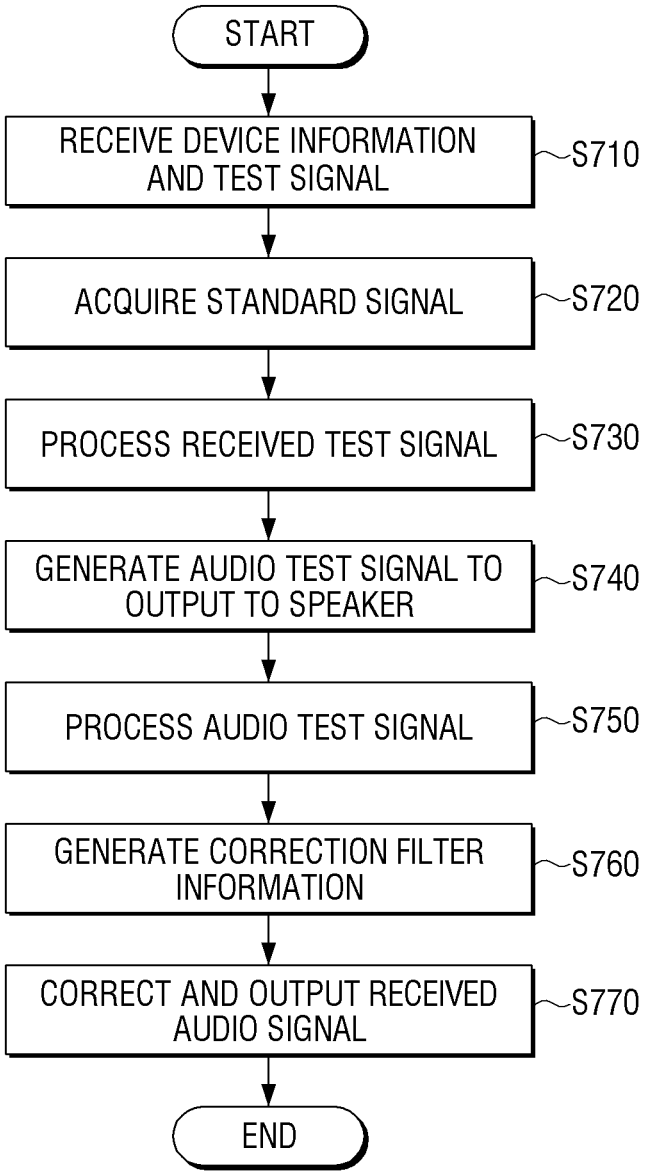
FIG. 7 is a first flowchart of a method for correcting an audio signal of a terminal device at an audio output apparatus according to an exemplary embodiment.

FIG. 7 is a first flowchart of a method for correcting an audio signal of a terminal device at the audio output apparatus according to an exemplary embodiment.

As described with reference to FIG. 6, the audio output apparatus receives a test signal and device information from at least one terminal device among a plurality of terminal devices (S710). Subsequently, based on the received device information, the audio output apparatus acquires a standard signal of the terminal device which transmits the test signal from among a plurality of pre-stored standard signals (S720). The acquired standard signal of the terminal device corresponds with the received device information. However, the exemplary embodiments are not limited thereto. The audio output apparatus may generate a notification message based on the received device information and display the notification message on screen as described above. Subsequently, when a command to select a terminal device corresponding to the notification message displayed on screen is input, the audio output apparatus may acquire a standard signal of the terminal device corresponding to the input selection command.

When the standard signal is acquired, the audio output apparatus converts the received test signal into a digital signal (S730). Subsequently, the audio output apparatus converts the digital test signal into an audio test signal to output to the speaker (S740). Subsequently, the audio output apparatus converts the audio test signal into a digital signal (S750), generates correction filter information of the terminal device based on the digital audio test signal and the acquired standard signal, and stores the correction filter information (S760). Subsequently, when an audio signal is received from the terminal device, the audio output apparatus corrects the received audio signal based on the stored correction filter information of the terminal device, and outputs the corrected audio signal through the speaker (S770).

In operation S760, the audio output apparatus may generate the correction filter information of the terminal device based on the digital audio test signal, the acquired standard signal, and a supply voltage (hereinafter, "a reference supply voltage") or an output voltage (hereinafter, "a reference output voltage") of the outputter 140 to output the audio test signal through the speaker 170.

In particular, when the audio output apparatus generates the audio test signal in operation S740, the audio output apparatus matches a reference supply voltage or a reference output voltage of power supplied to the outputter 140 with the generated correction filter information, and stores the matched information. Subsequently, when an audio signal is received from the terminal device, the audio output apparatus corrects the audio signal based on the correction filter information stored in operation S760. Subsequently, the audio output apparatus compares the reference supply voltage or the reference output voltage, which is matched with the correction filter information of the terminal device and is stored, with a supply voltage of the outputter 140 to output the corrected audio signal. In other words, the audio output apparatus determines whether the supply voltage of the outputter 140 to output the corrected audio signal is within a predetermined critical range of the reference supply voltage or the reference output voltage. When it is determined that the supply voltage of the outputter 140 is not within the predetermined critical range, the audio output apparatus adjusts the supply voltage of the outputter 140 to the reference supply voltage or the reference output voltage. When the supply voltage of the outputter 140 is adjusted to the reference supply voltage or the reference output voltage, the audio output apparatus may output the corrected audio signal through the speaker 170.

As described above, the audio output apparatus, consistent with the exemplary embodiment, may not only correct an audio signal having an error generated at a terminal device and an error generated in the process of transmitting an audio signal from the terminal device to the audio output apparatus, but also correct an audio signal having an error generated in the process of outputting an audio signal through the speaker 170 and an error generated in the process of supplying power.

Figure 8:
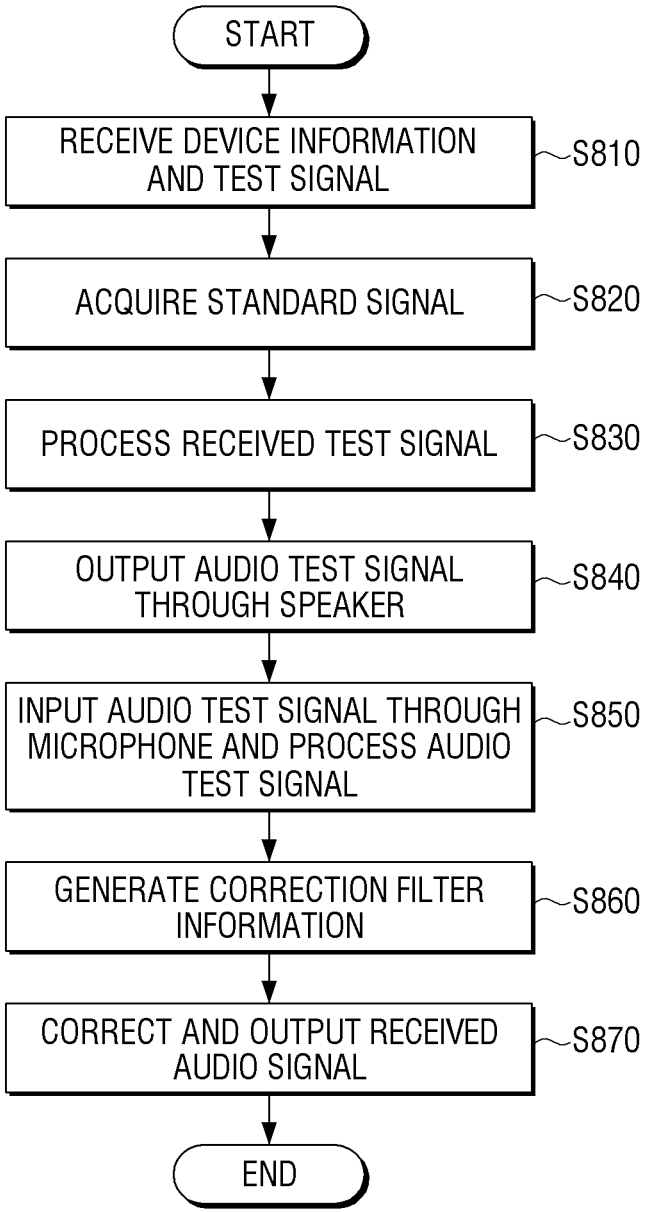
FIG. 8 is a second flowchart of a method for correcting an audio signal of a terminal device at an audio output apparatus according to another exemplary embodiment.

FIG. 8 is a second flowchart of a method for correcting an audio signal of a terminal device at the audio output apparatus according to another exemplary embodiment.

As described with reference to FIG. 6, the audio output apparatus receives a test signal and device information from at least one terminal device among a plurality of terminal devices (S810). Subsequently, based on the received device information, the audio output apparatus acquires a standard signal of the terminal device which transmits the test signal from among a plurality of pre-stored standard signals (S820). The acquired standard signal of the terminal device corresponds with the received device information. However, the exemplary embodiments are not limited thereto. The audio output apparatus may generate a notification message based on the received device information and display the notification message on screen as described above. Subsequently, when a command to select a terminal device corresponding to the notification message displayed on screen is input, the audio output apparatus may acquire a standard signal of the terminal device corresponding to the input selection command.

When the standard signal is acquired, the audio output apparatus converts the received test signal into a digital signal (S830). Subsequently, the audio output apparatus converts the digital test signal into an audio test signal and outputs the audio test signal through the speaker (S840). When the audio test signal is output through the speaker, the audio output apparatus receives the audio test signal through the microphone, and converts the received audio test signal into a digital signal (S850). Subsequently, the audio output apparatus generates correction filter information of the terminal device based on the digital audio test signal and the acquired standard signal, and stores the correction filter information (S860). Subsequently, when an audio signal is received from the terminal device, the audio output apparatus corrects the audio signal based on the stored correction filter information of the terminal device, and outputs the corrected audio signal through the speaker 170 (S870).

In operation S860, the audio output apparatus may generate the correction filter information of the terminal device based on the digital audio test signal, the acquired standard signal, and a supply voltage (hereinafter, "a reference supply voltage") or an output voltage (hereinafter, "a reference output voltage") of the outputter 140 to output the audio test signal through the speaker 170.

In particular, when the audio output apparatus generates the audio test signal to output to the speaker in operation S840, the audio output apparatus matches a reference supply voltage or a reference output voltage of the outputter 140 to output the audio test signal to the speaker 170 with the generated correction filter information, and stores the matched information. Subsequently, when an audio signal is received from the terminal device, the audio output apparatus corrects the received audio signal based on the correction filter information stored in operation S860. Subsequently, the audio output apparatus compares the reference supply voltage or the reference output voltage, which is matched with the correction filter information of the terminal device and is stored, with a supply voltage of the outputter 140 to output the corrected audio signal. In other words, the audio output apparatus determines whether the supply voltage of the outputter 140 to output the corrected audio signal is within a predetermined critical range of the reference supply voltage or the reference output voltage. When it is determined that the supply voltage of the outputter 140 is not within the predetermined critical range, the audio output apparatus adjusts the supply voltage of the outputter 140 to the reference supply voltage or the reference output voltage. When the supply voltage of the outputter 140 is adjusted to the reference supply voltage or the reference output voltage, the audio output apparatus may output the corrected audio signal through the speaker 170.

As described above, audio output apparatuses consistent with the exemplary embodiments, may correct audio signals of diverse terminal devices. That is, the audio output apparatuses may not only correct an audio signal having an error generated at a terminal device and an error generated in the process of transmitting an audio signal from the terminal device to the audio output apparatus, but may also correct an audio signal having an error generated in the process of outputting an audio signal through the speaker 170 and an error generated in the process of supplying power.

The foregoing exemplary embodiments and advantages are merely exemplary and are not to be construed as limiting. The present teaching can be readily applied to other types of apparatuses. Also, the description of the exemplary embodiments is intended to be illustrative, and not to limit the scope of the claims, and many alternatives, modifications, and variations will be apparent to those skilled in the art.

What is claimed is:

1. An audio correction method performed by an audio output apparatus, the audio correction method comprising:

receiving a test signal and device information from a terminal device;

selecting a reference signal corresponding to the terminal device from among a plurality of pre-stored reference signals based on the received device information;

generating correction filter information of the terminal device based on the selected reference signal and the received test signal;

in response to an audio signal being received from the terminal device, correcting the received audio signal based on the correction filter information; and outputting the corrected audio signal.

2. The audio correction method as claimed in claim 1, further comprising:

in response to the test signal being received from the terminal device, converting the received test signal into a digital signal in order to generate the correction filter information of the terminal device.

3. The audio correction method as claimed in claim 2, wherein the selecting the reference signal comprises:

in response to receiving a selection command to select at least one device information among the received device information, the reference signal of the terminal device, which is related to the device information corresponding to the selection command, is selected among the plurality of pre-stored reference signals.

4. The audio correction method as claimed in claim 2, further comprising:

generating an audio test signal for the test signal converted digital signal, converting the audio test signal into a digital signal, and wherein the generating comprises generating the correction filter information of the terminal device based on the audio test signal converted into the digital signal and the selected reference signal.

5. The audio correction method as claimed in claim 4, wherein the generating comprises generating the correction filter information of the terminal device based on the audio test signal converted into the digital signal, the selected reference signal, and a supply voltage of an outputter which is configured to output the audio test signal to a speaker.

6. The audio correction method as claimed in claim 4, wherein the generating comprises generating the correction filter information of the terminal device based on the audio test signal converted into the digital signal, the selected reference signal, and an output voltage of an outputter which is configured to output the audio test signal to a speaker.

7. The audio correction method as claimed in claim 2, further comprising:

generating an audio test signal for the converted digital signal, and outputting the audio test signal through a speaker; and receiving the output audio test signal from the speaker through a microphone; converting the audio test signal into a digital signal, wherein the generating comprises generating the correction filter information of the terminal device based on the audio test signal converted the into digital signal and the selected reference signal.

8. The audio correction method as claimed in claim 7, wherein the generating comprises generating the correction filter information of the terminal device based on the audio test signal converted into the digital signal, the selected reference signal, and a supply voltage of an outputter which is configured to output the audio test signal to a speaker.

9. The audio correction method as claimed in claim 7, wherein the generating further comprises generating the correction filter information of the terminal device based on the audio test signal converted into the digital signal, the selected reference signal, and an output voltage of an outputter which is configured to output the audio test signal to a speaker.

10. An audio output apparatus comprising:

a communicator configured to receive a test signal and device information from a terminal device;

an outputter configured to output an audio signal received from the at least one terminal device through a speaker; and a controller configured to select a reference signal corresponding to the terminal device from among a plurality of pre-stored reference signals based on the received device information and generate correction filter information of the terminal device based on the received test signal and the selected reference signal, and in response to the audio signal being received from the terminal device, correct the received audio signal based on the correction filter information.

11. The audio output apparatus as claimed in claim 10, further comprising:

a signal processor configured to convert the received test signal into a digital signal in order to generate the correction filter information of the terminal device.

12. The audio output apparatus as claimed in claim 11, further comprising:

an inputter configured to receive a user command, wherein in response to a selected user command being input through the inputter to select the device information, the controller is further configured to select the reference signal of the terminal device related to the device information from a storage.

13. The audio output apparatus as claimed in claim 11, wherein the outputter is further configured to output an audio test signal to the speaker for the converted digital signal, and wherein the controller is configured to control the signal processor to process the audio test signal which is output to the speaker, and generate the correction filter information of the terminal device based on the processed audio test signal and the selected reference signal.

14. The audio output apparatus as claimed in claim 13, further comprising:

a power supplier configured to supply power, wherein the controller is configured to generate the correction filter information of the terminal device based on the processed audio test signal converted into the digital signal, the selected reference signal, and a supply voltage of the power which is supplied from the power supplier to the outputter.

15. The audio output apparatus as claimed in claim 13, further comprising:

a power supplier configured to supply power, wherein the controller is configured to generate the correction filter information of the terminal device based on the audio test signal converted into the digital signal, the selected reference signal, and an output voltage of the power which is supplied from the power supplier to the outputter.

16. The audio output apparatus as claimed in claim 11, further comprising:

a microphone, wherein the outputter is configured to output through the speaker an audio test signal for the converted digital signal, and wherein the controller is configured to, in response to the audio test signal output through the speaker being input through the microphone, control the signal processor to process the audio test signal, and generate the correction filter information of the terminal device based on the processed audio test signal and the selected reference signal.

17. The audio output apparatus as claimed in claim 16, further comprising:

a power supplier configured to supply power, wherein the controller is configured to generate the correction filter information of the terminal device based on the processed audio test signal, the selected reference signal, and a supply voltage of the power which is supplied from the power supplier to the outputter.

18. The audio output apparatus as claimed in claim 16, further comprising:

a power supplier configured to supply power, wherein the controller is configured to generate the correction filter information of the terminal device based on the processed audio test signal, the selected reference signal, and an output voltage of the power which is supplied from the power supplier to the outputter.

* * * * *